US008679292B2

(12) United States Patent
Hamad et al.

(10) Patent No.: US 8,679,292 B2
(45) Date of Patent: Mar. 25, 2014

(54) COMPOSITE OF HYDROPHOBIC LIGNOCELLULOSE MATERIAL BONDED TO COMPLEMENTARY MATERIAL

(75) Inventors: Wadood Y. Hamad, Vancouver (CA); Ali Hayek, Burnaby (CA)

(73) Assignee: Fpinnovations, Pointe-Claire, QC (CA)

( * ) Notice: Subject to any disclaimer, the term of this patent is extended or adjusted under 35 U.S.C. 154(b) by 0 days.

(21) Appl. No.: 13/115,642

(22) Filed: May 25, 2011

(65) Prior Publication Data

US 2011/0308750 A1 Dec. 22, 2011

Related U.S. Application Data

(60) Provisional application No. 61/348,414, filed on May 26, 2010.

(51) Int. Cl.

| | |
|---|---|
| ***D21H 17/33*** | (2006.01) |
| ***D21H 17/35*** | (2006.01) |
| ***C08F 251/00*** | (2006.01) |
| ***D06M 14/04*** | (2006.01) |

(52) U.S. Cl.

USPC ..... 162/9; 162/125; 162/157.6; 162/182; 428/361; 428/537.5; 536/56

(58) Field of Classification Search

USPC ..... 162/9, 70, 72, 100, 157.6, 182, 123, 162/125; 536/56, 58, 60, 69, 84; 428/297.4, 428/361, 393, 411.1, 537.5; 8/115.51, 8/116.1

See application file for complete search history.

(56) References Cited

U.S. PATENT DOCUMENTS

| | | | | |
|---|---|---|---|---|
| 3,083,118 | A * | 3/1963 | Bridgeford | 428/375 |
| 3,770,575 | A | 11/1973 | Ball | |
| 4,151,130 | A * | 4/1979 | Adams | 525/54.3 |
| 4,343,680 | A | 8/1982 | Field et al. | |
| 4,891,415 | A * | 1/1990 | Lin et al. | 527/400 |
| 5,160,789 | A * | 11/1992 | Barcus et al. | 428/361 |
| 5,443,899 | A * | 8/1995 | Barcus et al. | 442/330 |
| 5,741,875 | A * | 4/1998 | Meister et al. | 527/400 |
| 5,817,079 | A | 10/1998 | Bergquist et al. | |
| 6,013,774 | A * | 1/2000 | Meister et al. | 530/507 |
| 6,117,545 | A | 9/2000 | Cavaille et al. | |
| 6,472,487 | B2 * | 10/2002 | Schroeder et al. | 526/263 |
| 6,680,090 | B2 * | 1/2004 | Godavarti et al. | 428/34 |
| 6,682,789 | B2 * | 1/2004 | Godavarti et al. | 428/34 |
| 6,703,497 | B1 | 3/2004 | Ladouce et al. | |
| 6,844,066 | B2 * | 1/2005 | Hamed | 428/393 |
| 6,846,573 | B2 | 1/2005 | Seydel | |
| 7,018,945 | B2 * | 3/2006 | Yahiaoui et al. | 442/118 |
| 8,173,799 | B2 * | 5/2012 | Gillette et al. | 536/124 |
| 2003/0017319 | A1 * | 1/2003 | Hamad et al. | 428/297.4 |
| 2005/0245159 | A1 | 11/2005 | Chmielewski et al. | |
| 2007/0131362 | A1 * | 6/2007 | Buchert et al. | 162/9 |
| 2009/0197084 | A1 * | 8/2009 | Sun et al. | 428/401 |
| 2010/0065499 | A1 * | 3/2010 | Fernandez-Lahore et al. | 210/656 |
| 2011/0189473 | A1 * | 8/2011 | Mente | 428/326 |
| 2011/0282048 | A1 * | 11/2011 | Brumer et al. | 536/57 |
| 2011/0308750 | A1 * | 12/2011 | Hamad et al. | 162/157.1 |
| 2012/0041183 | A1 * | 2/2012 | Hu et al. | 530/502 |

FOREIGN PATENT DOCUMENTS

| | | |
|---|---|---|
| GB | 2260138 | 4/1993 |
| WO | WO 2010105357 A1 * | 9/2010 |

OTHER PUBLICATIONS

Bianchini et al., "Free radical grafting onto cellulose in homogeneous conditions. 2. Modified cellulose-methyl methacrylate system," 2000, Carbohydrate polymers, vol. 41, pp. 47-53.*

A. Hebeish, A. Waly, F. A. Abdel-Mohdy, A. S. Aly, J. Appl. Polym. Sci., 1997, 66, 1029-1037.

X. Xing, D. Lu, X. Wang, Z. Liu, J. Macromol. Sci. Pure and Appl. Chem., 2009, 46, 560-565.

T. Nonaka, E. Noda, S. Kurihara, J. Appl. Polym. Sci., 2000, 77, 1077-1086.

S. B. Lee, R. R. Koepsel, S. W. Morley, K. Matyjaszewski, Y. Sun, A. J. Russell, Biomacromolecules, 2004, 5, 877-882.

S. Ko, J. Jang, Biomacromolecules, 2007, 8, 1400-1403.

G. Raju, C. T. Ratnam, N. A. Ibrahim, M. Z. Ab. Rahman, W. M. Z. Wan Yunus, Polym. Plastics Tech. Eng., 2007, 46, 949-955.

M. K. Sreedhar, T. S. Anirudhan, J. Appl. Polym. Sci., 2000, 75, 1261-1269.

J. M. Felix, C. M. G. Carlsson, P. Gatenholm, J. Adhes. Sci. Technol, 1994, 8, 163-180.

D. Basu, A. K. Khan, T. K. Maji, A. Banejee, J. Appl. Polym. Sci., 1998, 69, 2585-2591.

Rozman, H.D. et al. (1994) Journal of Applied Polymer Science, vol. 54, 191-200.

Kokta, B.V. et al. (1987) Journal of Applied Polymer Science, vol. 34, 2517-2526.

International Search Report, PCT/CA2011/000622, dated Sep. 13, 2011.

* cited by examiner

*Primary Examiner* — Jose Fortuna

(74) *Attorney, Agent, or Firm* — Norton Rose Fulbright Canada LLP

(57) ABSTRACT

A method is conceived for producing hydrophobic lignocellulosics based on the graft copolymerisation of vinyl-type monomers onto the lignocellulosic backbone initiated by a redox couple initiator in aqueous medium. The green modification process can be carried out on any lignocellulosic material, for example, chemical, chemi-thermomechanical or thermo-mechanical pulps, bleached or unbleached. The technology disclosed in this invention yields individual lignocellulosic entities, for instance, hydrophobic pulp fibers, that can be used in combination with other fibers or polymers to produce nonwoven fibrous materials or composites. A significant aspect of the invention is that the modified lignocellulosic material possesses an efficient hydrophobic barrier and minimum interfacial energy to generate optimum adhesion when introduced to polymer resins. Hydrophobic lignocellulosics can have wide applications in products requiring high dimensional stability and excellent adhesion as in fiber-based packaging, decorative laminates, furniture and non-structural biocomposites.

14 Claims, 5 Drawing Sheets

COMPOSITE OF HYDROPHOBIC LIGNOCELLULOSE MATERIAL BONDED TO COMPLEMENTARY MATERIAL

CROSS-REFERENCE TO RELATED APPLICATION

This application claims the benefit under 35 USC 119(e) of U.S. Provisional Application 61/348,414, filed May 26, 2010.

BACKGROUND OF THE INVENTION

1. Field of the Invention

This invention relates to hydrophobic lignocellulosic materials and a process for producing them, as well as composite materials containing them. The hydrophobic lignocellulosic materials have wide application in products requiring high dimensional stability and excellent adhesion as in fibre-based packaging, decorative laminates, furniture and non-structural biocomposites.

2. Description of the Prior Art

Lignocellulosic fibres are hydrophilic. This renders them highly susceptible to loss of mechanical properties upon moisture absorption, which is a critical shortcoming for paper and board applications requiring a high degree of dimensional stability and low hygroexpansivity. In addition, the highly polar nature of lignocellulosics makes them poorly compatible with commonly non-polar polymers used in the production of textiles and composites. One possible solution to this limitation could be the enhancement of the surface energy of lignocellulosic materials. Surface modification has been used to target several applications of modified cellulosic materials such as: cellulose ion exchangers, antibacterial papers, protein immobilizers, composite material, products for mercury (II) removal from wastewater. Surface modification can potentially enhance the compatibility of lignocellulosic fibres with polymers in composites and related applications.

All reported applications for developing moisture-resistant paper and board products involve the application of hydrophobic surface coatings to the finished product. For example, U.S. Pat. No. 6,846,573 to Seydel, discloses the preparation of moisture resistant and water proof paper products that can be repulped and recycled, through use of hydrogenated triglycerides as surface coatings.

Other methods have been reported to prepare hydrophobic fibres. For instance, U.S. Patent Application No. 2005/0245159 A1 to Chmielewski discloses a technique to prepare breathable barrier composites with hydrophobic cellulosic fibres by applying a polymeric sizing agent such as alkyl ketene dimer. Although this chemical is purported to be covalently attached to the surface of the fibres, the modified fibres are only moderately hydrophobic.

U.S. Pat. No. 3,770,575 to Ball discloses a method for making a hydrophobic fibrous product that may be used to absorb oil from the surface of water. The hydrophobic fibres are made from a synthetic sizing agent, and the sized pulp is then dried and compressed in bales. This technique was employed by Bergquist, U.S. Pat. No. 5,817,079, in which Bergquist discloses a selective placement of absorbent product materials in sanitary napkins and the like. U.S. Pat. No. 4,343,680 to Field discloses a method for the preparation of hydrophobic oleophilic wood pulp by treating high yield wood pulp at high temperature for about 16 hours followed by fluffing of the heat treated pulp. According to the inventors, this hydrophobic pulp may be used as an inexpensive absorbent for oil spills and the like.

SUMMARY OF THE INVENTION

It is an object of this invention to provide hydrophobic cellulosic or lignocellulosic fibre material.

It is another object of this invention to provide a process for producing hydrophobic cellulosic or lignocellulosic fibre material.

It is yet another object of this invention to provide a composite of hydrophobic cellulosic or lignocellulosic fibre material and a second material.

In accordance with one aspect of the invention, there is provided a hydrophobic cellulosic or lignocellulosic fibre material comprising a hydrophilic cellulosic or lignocellulosic fibre material having a fibre backbone, and a hydrophobic polymer material grafted on the backbone.

In accordance with another aspect of the invention, there is provided a process for preparing a hydrophobic cellulosic or lignocellulosic fibre material comprising reacting hydrophilic cellulosic or lignocellulosic fibre material with a monomer which polymerizes to form a hydrophobic polymer material, in the presence of a free radical initiator for the hydrophilic cellulosic or lignocellulosic fibre material.

In accordance with still another aspect of the invention, there is provided a process for preparing a hydrophobic cellulosic or lignocellulosic fibre material comprising forming a free radical on a fibre backbone of hydrophilic cellulosic or lignocellulosic fibre material, reacting a vinyl monomer with the free radical and polymerizing the vinyl monomer to form hydrophobic polymer material grafted on said backbone.

In another aspect of the invention, there is a provided a composite material comprising a hydrophobic cellulosic or lignocellulosic fibre material of the invention, and a complementary material, for example a polymer resin or a hydrophilic fibre material.

DETAILED DESCRIPTION OF THE INVENTION

Figure 1:
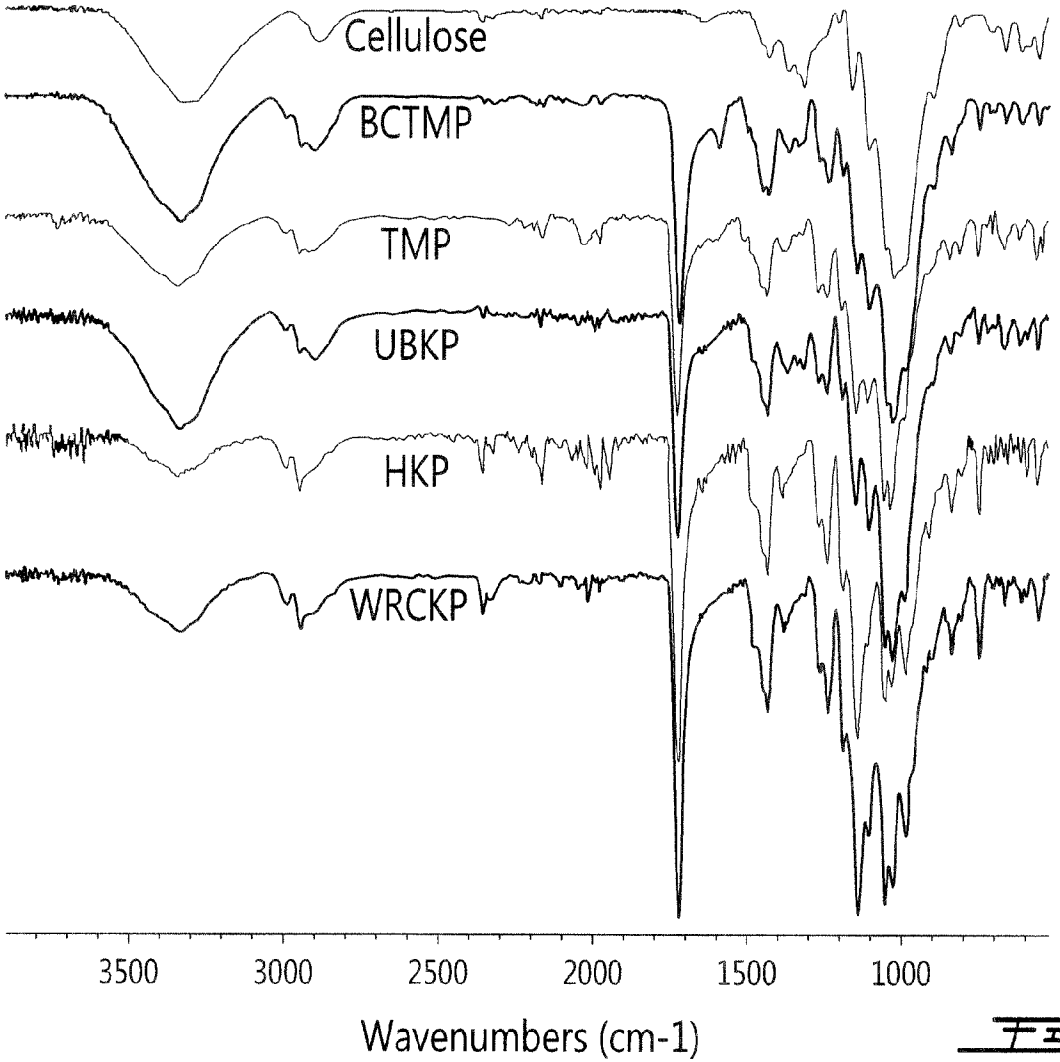
FIG. 1: is Fourier-transform infrared (FT-IR) spectra of modified fibres of the invention, which show, in addition to the peaks of the control lignocellulosic pulp fibres, strong peaks at 1725 $cm^{-1}$ which corresponds to the carboxyl group (C═O) of ester function of the methacrylate moiety. Legend: Cellulose=Lignocellulosic pulp fibre (control); BCTMP=Bleached chemi-thermal mechanical pulp fibres; TMP=Thermo-mechanical pulp fibres; UBKP=Unbleached kraft hemlock pulp fibres; HKP=Bleached hemlock kraft pulp fibres; WRCKP=Bleached western red cedar kraft pulp fibres.

Hydrophobic lignocellulosic materials are produced through graft copolymerization of polymerizable molecules onto lignocellulosic materials in aqueous medium. The process is a green modification process and can be carried out on any lignocellulosic material, for example, chemical, chemi-thermo-mechanical or thermo-mechanical pulps, bleached or unbleached.

The technology disclosed in this invention yields individual lignocellulosic entities, for instance, hydrophobic pulp fibres, that can be used in combination with other fibres or polymers to produce nonwoven fibrous materials or composites.

A significant aspect of the invention is that the modified lignocellulosic material possesses an efficient hydrophobic barrier and minimum interfacial energy to generate optimum adhesion when introduced to polymer resins. Surface modification via graft copolymerisation can be integrated into pulp production and carried out during, before or after the bleaching process.

The method is conceived for producing hydrophobic lignocellulosics based on the graft copolymerisation of vinyl-type monomers onto the lignocellulosic backbone initiated by a redox couple initiator in aqueous medium. The green modification process can be carried out on any lignocellulosic material, for example, chemical, chemi-thermo-mechanical or thermo-mechanical pulps, bleached or unbleached.

Hydrophobic lignocellulosics can have wide applications in products requiring high dimensional stability and excellent adhesion as in fibre-based packaging, decorative laminates, furniture, non-structural biocomposites, cellulose ion exchangers, antibacterial papers, protein immobilizers and for mercury (II) removal from wastewater.

Hydrophobic lignocellulosics can be produced by introducing hydrophobic moieties onto the lignocellulosic backbone of the fibres, for instance, by graft copolymerization of vinyl-type monomers onto the backbone.

Graft copolymerization in the process of the invention, in principle comprises three different steps: initiation, propagation and termination. In this process, free radicals are generated for the purpose of forming interfacial strong bonding such as covalent bonds between the fibres and the polymerizable material or monomer.

The initiation step is key to a successful graft copolymerisation process. The yield and efficiency of grafting essentially depend on the successful generation of radicals onto the lignocellulosic fibres, whereby a macroradical is formed. The term macroradical typically applies to the fibre itself where radicals have been generated on different sites on the fibre surface. These sites could be the potential radical generator functions in the lignin molecules and/or the hydroxyl groups or the carbon atoms of the carbinol groups of cellulose in lignocellulosic materials. For low lignin-content fibres, such as kraft pulp, radicals are usually generated only from the hydroxyl groups or the carbon atoms of the carbinol groups of cellulose. Once the macroradicals are formed, they react with the vinyl-type monomers in their proximity, thereafter the graft copolymerization proceeds and this process is called propagation. The termination of the graft copolymerization process occurs by a chain transfer reaction or a combination of processes.

The redox initiators used to generate free radicals onto the lignocellulosic backbone depend on the carbohydrates making up the lignocellulosic material. For materials that contain significant amounts of lignin—as in TMP and CTMP, peroxide based oxidants such as hydrogen peroxide are the desired initiators for the copolymerisation reaction. The reaction, in this case, is described as follows:

$$\text{Fibre} + H_2O_2 + Fe^{2+} \xrightarrow{HNO_3} \text{Fibre}^{\bullet} + H^{\bullet}$$

However, in the case of lignocellulosic materials with practically little or no lignin, as in chemical pulps, the redox initiator couple used to generate free radicals onto the cellulosic fibres is ideally a periodate based oxidant such as a $Cu^{2+}/IO_4^-$ couple. The reaction is therefore described as follows:

$$\text{Fibre} + CuSO_4{\bullet}5H_2O + KIO_4 \xrightarrow{H_2O} \text{Fibre}^{\bullet} + H^{\bullet}$$

The propagation and termination reactions for lignocellulosics with high and low lignin contents are as follows, respectively:

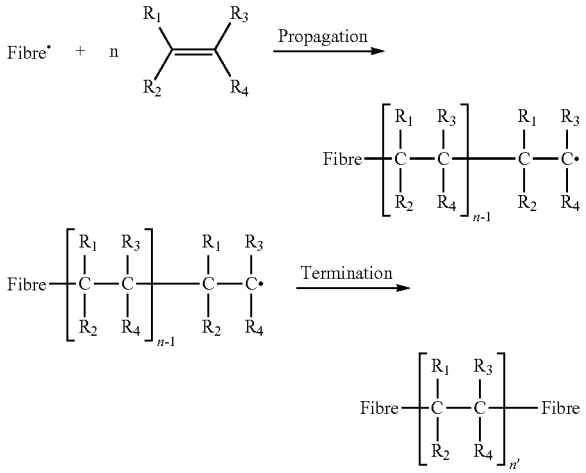

In the illustrated termination, the polymerized monomer forms a graft bridge between separate fibres, in which a second fibre provides a terminating radical for the polymerization, however it will be understood that the termination could be at a different free radical site on the same fibre or by way of a chemical terminator or cap; in the latter case the fibre would have pendant polymer chains with a free end. It is also possible to have a combination of these terminations throughout the fibre material. The preferred termination path would be a different free radical site on the same fibre. The most likely embodiment is a combination of these different terminations throughout the fibre material.

In the reaction scheme illustrated n is an integer indicating the extent of polymerization and typically may be anything equal to or greater than 3, most likely 3-100. This invention is not limited to only these types of oxidants; the chemical initiator could be any other suitable chemical initiator listed in, for instance, the Polymer Handbook, Interscience 1966, pp. II-3 to II-51. Suitable examples include: ceric ammonium nitrate, Co (III) acetylacetonate complex, other $Cu^{2+}/IO_4^-$ couples (such as Potassium Diperiodatocuprate (III) and the like), cerium (IV)—DMSO redox couple, etc. Furthermore, the free radical initiators can be generated using radiation sources such as gamma radiation, ultraviolet radiation, laser radiation or ultrasonic.

The co-initiator used in the copolymerization process is a reductant agent. As an example, iron (II) could be used for this purpose, as illustrated above. Copper manganese, chromium, vanadium or any other cation able to carry out oxidation-reduction reactions with the initiator could likewise be used. The initiation process can be speeded up by using acids that are able to dissociate into radicals, such as sulphuric acid or nitric acid. However, this invention is not only limited to the cited acids. Other catalysts could be used as well to enhance the performance of the redox couple initiator, such as hydroquinone.

Optimization can be achieved by adjusting the conditions of copolymerization, whereby the grafting yield and efficiency are intimately affected by (i) reaction time, (ii) polymerization temperature, (iii) amounts of initiator, co-initiator and monomer, and (iv) liquor ratio.

Typical monomers that can be used for grafting using this approach are: methyl methacrylate, butyl methacrylate and glycidyl methacrylate. However, this invention is not limited to such monomers or their weight ratios. Any kind of alkyl, aryl vinyl, allyl types or any double bond-containing molecules, neutral or bearing positive or negatives charges that can be polymerized through radical polymerization can be used. Examples are: acrylamide, methyl acrylate, butyl acrylate, 4-vinylpyridine, acrylic acid, dimethylaminoethyl methacylate, acrylonitrile or butyl methacrylate. In general, molecules for example macromolecules that can in situ polymerize in the presence of the fibre (i.e. attach to the fibre without crosslinking amongst themselves) are suitable as monomers in the invention. Acrylates are suitable candidates for this approach. However, molecules that may cross-link for example styrenes or butadienes are less likely to be suitable. Molecules that have medium range hydrophobicity relative to the lignocellulosic fibre may be preferred.

Hydrophobic fibres can be prepared according to this invention by suspending the lignocellulosic material in water to form a slurry of from 0.1 to 40% w/w consistency. 0.1 to 100% v/v (with respect to the liquor) of polymerizable material can then be added to the fibre slurry, followed by the addition of 0.1 to 20% w/v or v/v of chemical initiator, 0 to 20% w/v or v/v of co-initiator, 0 to 20% w/v or v/v of catalyst and 0 to 20% w/v or v/v of emulsifier, in order to bind the monomer to the fibre through free radical graft copolymerization process. The reaction time can range from 5 minutes to 48 hours, and the temperature from 20° C. to 100° C., typically between room temperature (~21° C.) and 100° C. The process is preferably carried out at a pulp consistency of from 0.5 to 5% w/w, more preferably 1.0% consistency, in the presence of 3-6% v/v of the polymerizable material. The initiator concentration is preferred to be 0.25% v/v accompanied by 0.05% w/v of the co-initiator and 0.6% v/v of the catalyst. The reaction temperature is adjusted around 60° C. for a reaction time around 60 minutes. In general a polymerized vinyl monomer of a hydrophobic material of the invention contains 3 to 30000, typically 3 to 1000, for example 3 to 100 vinyl monomer units.

Figure 2:
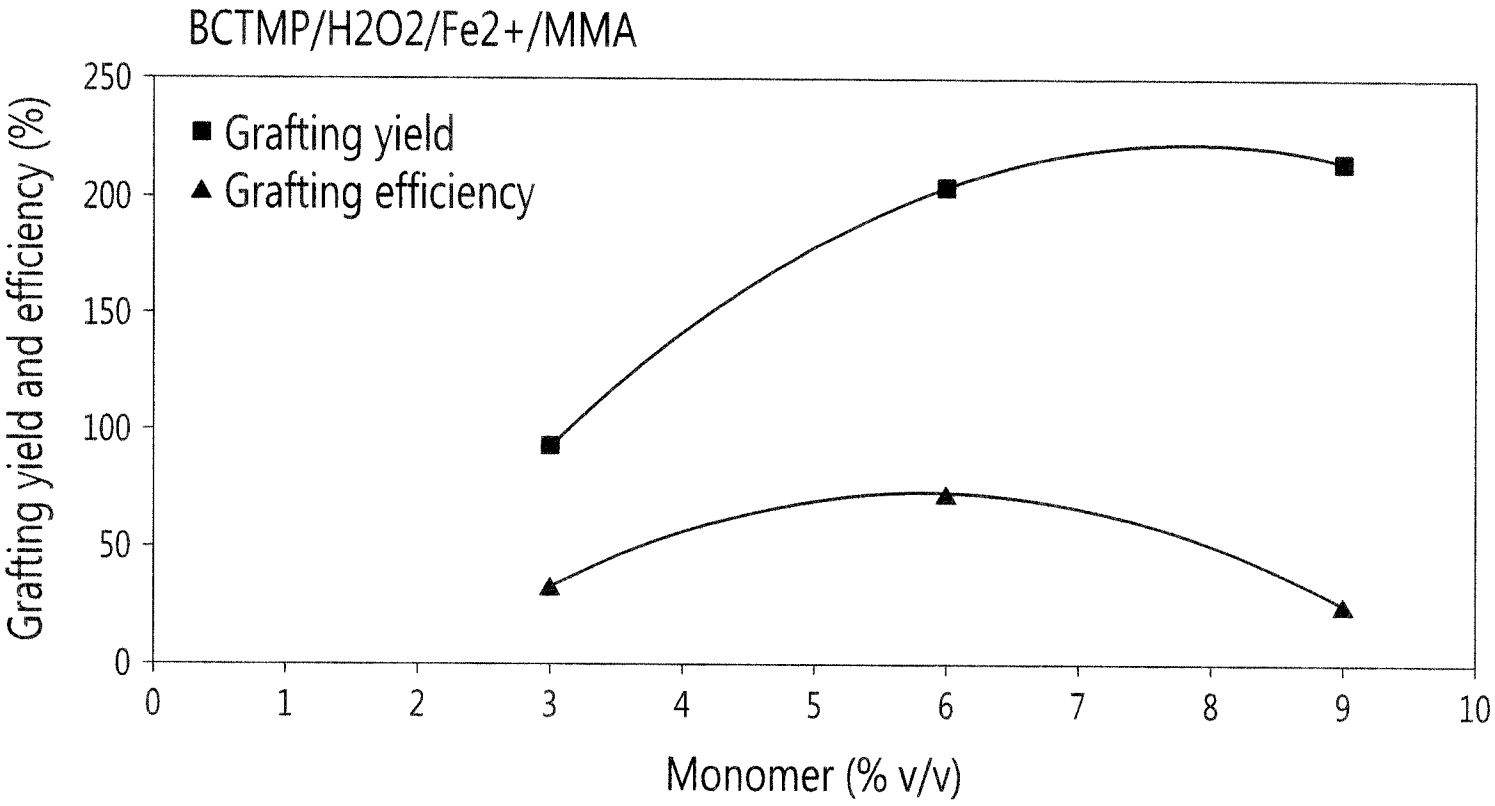
FIG. 2: is a plot of grafting yield/efficiency as a function of monomer (MMA) dosage for BCTMP using peroxide based oxidants, such as $H_2O_2$, initiator for the copolymerization reaction.
Figure 3:
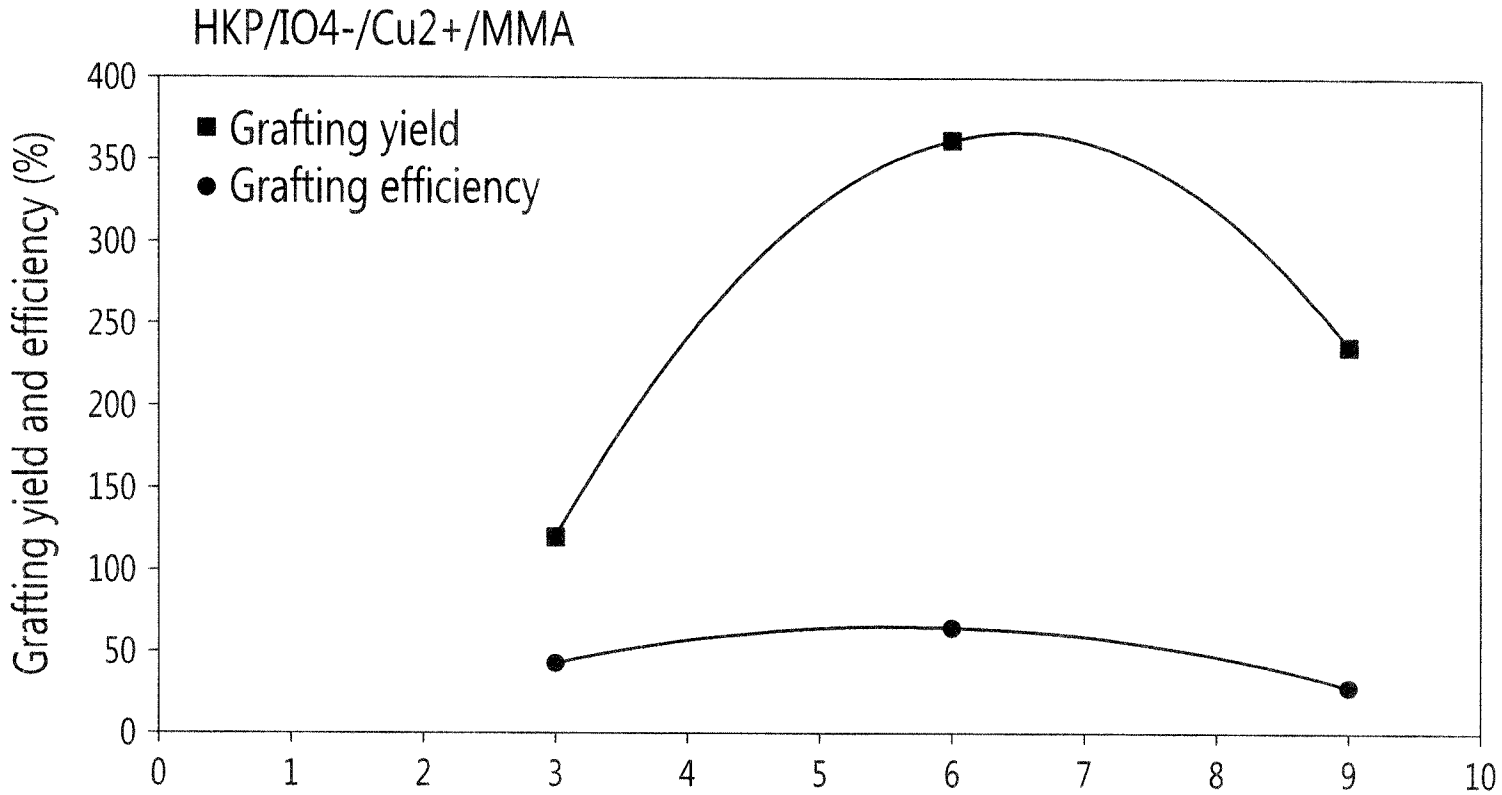
FIG. 3: is a plot of grafting yield/efficiency as a function of monomer (MMA) dosage for bleached hemlock kraft pulp (HKP) using periodate based oxidants, such as $Cu^{2+}/IO_4^-$, initiator for the copolymerization reaction.

FIG. 1 indicates that the grafting copolymerization process is successful for a wide range of lignocellulosic materials (see specific preparations below). The Fourier-transform infrared (FT-IR) spectra of modified fibres show, in addition to the peaks of the control lignocellulosic pulp fibres, strong peaks at 1725 $cm^{-1}$ which corresponds to the carboxyl group (C═O) of ester function of the methacrylate moiety. FIG. 2 and FIG. 3 depict, respectively, optimization scenarios of the copolymerization process as measured by the grafting yield and efficiency as a function of monomer (MMA) dosage for BCTMP using peroxide based oxidants, such as $H_2O_2$, initiator for the copolymerization reaction, and for bleached hemlock kraft pulp (HKP) using periodate based oxidants, such as $Cu^{2+}/IO_4^-$. The optimum grafting yield and efficiency for both systems occurs around 6% v/v MMA for this system.

Figure 4:
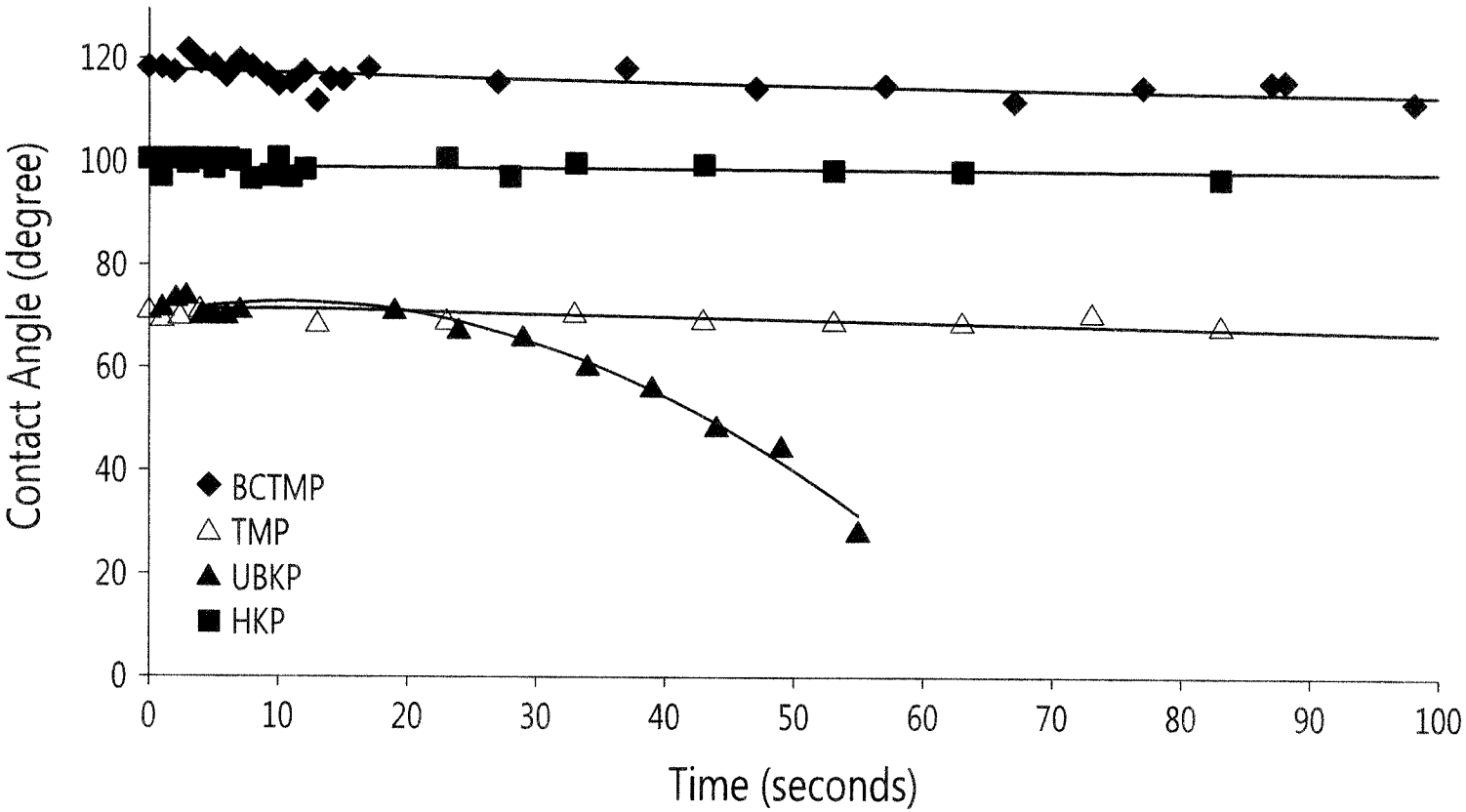
FIG. 4: is a plot of water contact angle measurements for surfaces prepared from the modified fibres of the invention. The surfaces evince hydrophobic characteristics as indicated by contact angle values around 98°. (Legend as in FIG. 1.)
Figure 5:
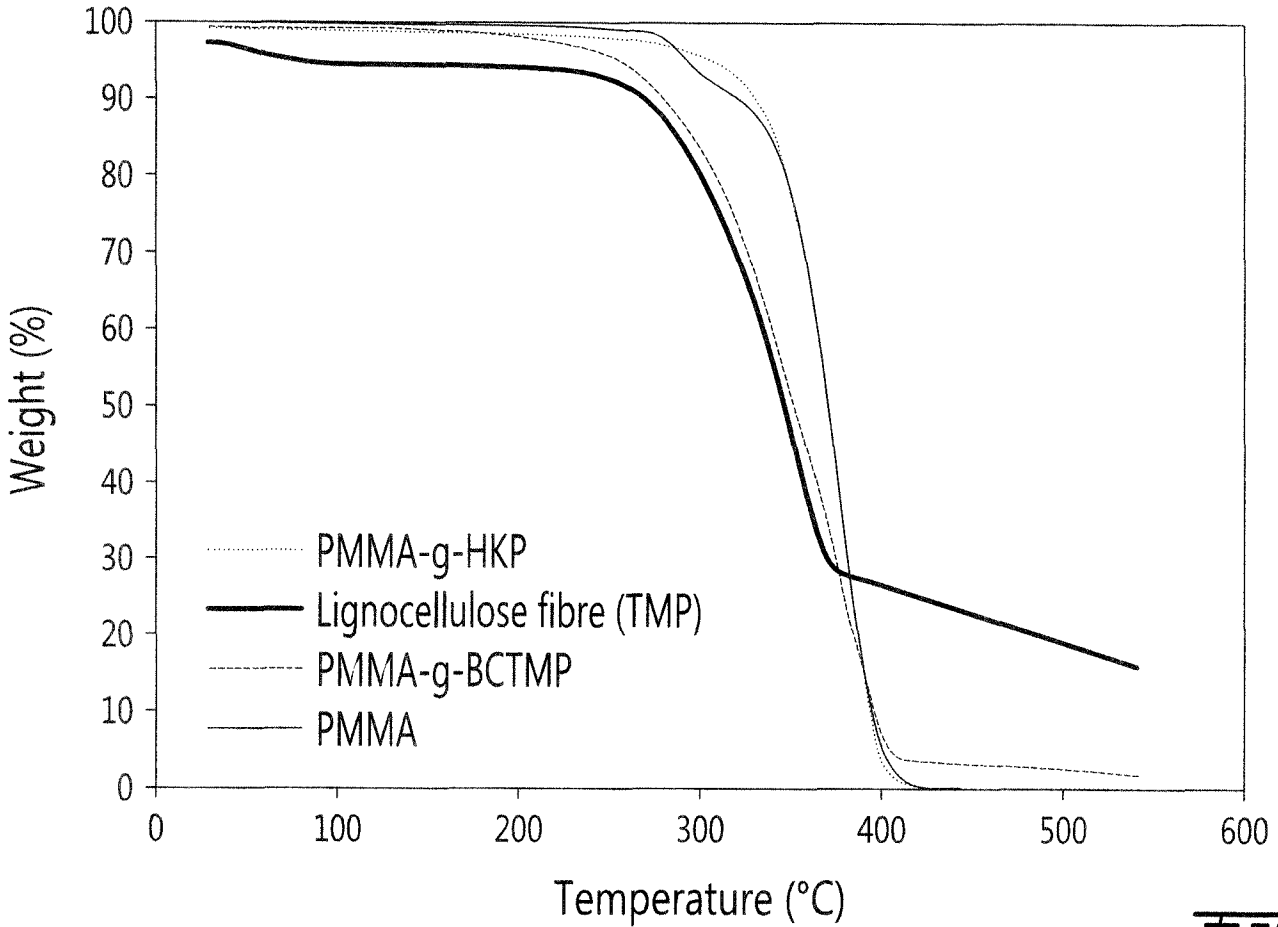
FIG. 5: is a plot of thermogravimetric curves for modified BCTMP (PMMA-g-BCTMP) and bleached hemlock kraft pulp (PMMA-g-HKP) fibres of the invention, in relation to the control lignocellulosic pulp fibre and PMMA.

Further direct experimental evidence of the successful graft copolymerization technique for developing moisture resistant lignocellulosics is presented in FIG. 4, where the hydrophobic characteristics are indicated by water contact angle values around 98° for a range of samples. The hydrophobic response is maintained for well over 100 seconds before the water droplet begins to be absorbed by the modified pulp fibres. In the case of unbleached kraft pulp, the contact angle remains steady for about 20 seconds, then starts to decrease. FIG. 5 presents the thermogravimetric curves for modified BCTMP (PMMA-g-BCTMP) and bleached hemlock kraft pulp (PMMA-g-HKP) in relation to the control lignocellulosic pulp fibre and PMMA. The lignocellulosic pulp fibres (solid black line) experiences a weight decrease as the temperature is raised to about 100° C., whereas the modified pulps (two dashed lines) do not exhibit this behaviour—they rather resemble PMMA (solid grey line) in this regard. This indicates that the modified fibres have been sufficiently shielded by the polymer during the grafting copolymerization process, and have become resistant to moisture loss or uptake. Both modified pulps start to degrade at higher temperatures than the virgin pulp, indicating better thermal stability and potentially efficient processability for subsequent product development.

The composites can comprise primarily fibre and polymer matrix, or they could be foamed materials where the hydrophobic lignocellulosic fibres are used to reinforce and functionalize the product. The composite could also be a laminate structure. Composites can comprise modified hydrophobic lignocellulosic fibres of the invention and a biopolymer, e.g., poly(hydroxyl butyrate)—or, in general, the alkanoates family—and poly(lactic acid); a polyolefin, e.g., poly(ethylene) or poly(propylene). Composites can be used to create low or ultra-low density materials for insulation, roof tiles, exterior cladding, or multi-functional panels. It could also be used for automotive parts or other building products that require a limited load-bearing capacity. Other examples include structural composites for construction and automotive applications. Non-structural biocomposites can include such applications as automotives (interior, floor mats, etc.) and construction (e.g. insulation). The hydrophobic lignocellulosic material can further enhance the barrier performance of the packaging material against moisture or water vapour.

The monomer species is important in providing the ability to achieve optimum bonding or adhesion. Basically, optimum adhesion is achieved if (i) the reinforcement and matrix have similar surface (free) energies to promote excellent interface, and (ii) the polarity of the reinforcement and matrix are comparable. Together, these will minimize the interfacial energy and promote better adhesion/bonding.

The present invention represents green technology under the US Environmental Protection Agency principles of green chemistry.

The pulp samples employed in FIGS. 1 to 5, are those of the Examples below.

Preparation 1: Bleached Chemi-Thermo-Mechanical Pulp (BCTMP) Material

Air-dried pulp sheets are disintegrated in boiled deionized (DI) water under vigorous stirring for 30 minutes. The pulp is filtered off, washed several times with DI water until obtaining a colourless clear filtrate, then pressed and stored wet at a consistency of ~20-25%. In a sealed 500-mL Erlenmeyer flask, an equivalent of 1.0 g oven dried pulp of wet aspen BCTMP (4.9 g wet; Cs=23.4%) is suspended in 100 mL of DI water in order to form a pulp slurry of 1.0% pulp consistency. 0.6 mL of concentrated nitric acid is then added and the slurry is deoxygenated by bubbling nitrogen flow through it for 30 minutes, while mixing vigorously in order to obtain well dispersed fibres in the suspension. Ferrous ammonium sulfate hexahydrate (51 mg, 1.3 mmol/L) is then added to the pulp slurry, followed by 0.75 mL of a 34-37% aqueous hydrogen peroxide (0.25% v/v). Five minutes later, 3.0 mL of methyl methacrylate (3.0% v/v) is added to the pulp slurry and the reaction mixture is heated to 60° C. for 1 hour under vigorous stirring. The pulp is then filtered off while warm. It is then dispersed in 400 mL of DI water, filtered, washed thoroughly with 3×500 mL of DI water, 3×50 mL of acetone then 2×500 mL of DI water, pressed and stored.

The pure grafted co-polymer (PMMA-g-fibre) is then dried at 110° C. to constant weight, and the grafting yield ($P_g$) is determined using the formula:

$$P_g = \frac{W_g - W_0}{W_0} \times 100\%$$

And the grafting efficiency, $E_g$, is defined as:

$$E_g = \frac{W_g - W_0}{W_m} \times 100\%$$

where $W_0$ is the oven dried weight of the original lignocellulosic material (pulp fibres) in grams, $W_g$ is the oven dried weight of the grafted product after copolymerization and washing, and $W_m$ is the weight of the monomer used. In this case, $P_g$=93%.

Preparation 2: Bleached Thermomechanical Pulp (TMP) Material

In a sealed 1-L Erlenmeyer flask, an equivalent of 5.0 g oven dried pulp of wet peroxide bleached TMP (21.9 g wet; Cs=22.9%) is suspended in 500 mL of DI water in order to form a pulp slurry of 1.0% pulp consistency. 3.0 mL of concentrated nitric acid is then added, and the slurry is deoxygenated by bubbling nitrogen flow through it for 30 minutes, while mixing vigorously in order to obtain well dispersed fibres in the suspension. Then, ferrous ammonium sulfate hexahydrate (255 mg, 1.3 mmol/L) is added to the pulp slurry, followed by 3.75 mL of a 34-37% aqueous hydrogen peroxide (0.25% v/v). Five minutes later, 15.0 mL of methyl methacrylate (3.0% v/v) is added to the pulp slurry and the reaction mixture is heated to 60° C. for 1 hour under vigorous stirring. The pulp is then filtered off while warm, and dispersed in 700 mL of DI water, filtered, washed thoroughly with 3×500 mL of DI water, 3×150 mL of acetone then 2×500 mL of DI water, pressed and stored. In this case, the grafting yield, $P_g$=141%.

Preparation 3: Unbleached Kraft Pulp (UBKP; High Lignin-Content).

In a sealed 1-L Erlenmeyer flask, an equivalent of 5.0 g oven dried pulp of wet unbleached hemlock kraft pulp (20.3 g wet; Cs=26.4%) is suspended in 500 mL of DI water in order to form a pulp slurry of 1.0% pulp consistency. 3.0 mL of concentrated nitric acid is then added and the slurry is deoxygenated by bubbling nitrogen flow through it for 30 minutes, while mixing vigorously in order to obtain well dispersed fibres in the suspension. Then, ferrous ammonium sulfate hexahydrate (255 mg, 1.3 mmol/L) is added to the pulp slurry followed by 3.75 mL of a 34-37% aqueous hydrogen peroxide (0.25% v/v). Five minutes later, 15.0 mL of methyl methacrylate (3.0% v/v) are added to the pulp slurry and the reaction mixture is heated to 60° C. for 1 hour under vigorous stirring. The pulp is then filtered off while warm, and dispersed in 700 mL of DI water, filtered, washed thoroughly with 3×500 mL of DI water, 3×200 mL of acetone then 2×500 mL of DI water, pressed and stored. The grafting yield in this case, $P_g$=158%.

Preparation 4: Bleached Hemlock Kraft Pulp (HKP)

In a sealed 1-L Erlenmeyer flask, equipped with a mixer and nitrogen inlet, 500 mL of DI water is introduced. The pH is adjusted to ~10.90 with aqueous potassium hydroxide, and then 5 g of oven dried bleached hemlock kraft pulp are introduced (1.0% consistency). The pulp slurry is deoxygenated by bubbling nitrogen flow through it for 35 minutes at 40° C., while mixing vigorously (700 rpm) in order to obtain well dispersed fibres in the suspension. Methyl methacrylate (15 mL, 3.0% v/v) is added to the pulp slurry while maintaining the nitrogen purging for an additional 10 minutes at the same temperature. Thereafter, 250 mg of copper sulphate pentahydrate (0.002 mol/L) is added and stirred until completely dissolving the blue solid, and the reaction mixture is stirred for an additional 20 minutes. 575 mg of potassium periodate (0.005 mol/L) is subsequently added to the slurry and the reaction mixture is heated to 60° C. for 30 minutes Another 15 mL of methyl methacrylate (3.0% v/v) is added and the reaction mixture is stirred for an additional 30 minutes. The pulp is then filtered off while warm, and dispersed in 3×500 mL of DI water, filtered, washed thoroughly with 2% aqueous sulphuric acid (500 mL), acetone (3×150 mL) then with DI water (3×500 mL), pressed and stored. $P_g$=362%.

Preparation 5: Bleached Western Red Cedar Kraft Pulp (WRCKP)

In a sealed 1-L Erlenmeyer flask, equipped with a mixer and nitrogen inlet, 500 mL of DI water is introduced. Copper sulphate pentahydrate (250 mg, 0.002 mol/L) is added and stirred until completely dissolving the blue solid, and 5 g of oven dried bleached western red cedar kraft pulp is suspended in the copper solution (1.0% consistency). The slurry is deoxygenated by bubbling nitrogen flow through it for 30 minutes at 40° C., while mixing vigorously (700 rpm) in order to obtain well dispersed fibres in the suspension. 30 mL of methyl methacrylate (6.0% v/v) is added to the pulp slurry while maintaining the nitrogen purging for an additional 30 minutes at the same temperature. 575 mg of potassium periodate (0.005 mol/L) are then added to the slurry and the reaction mixture is heated to 60° C. for 70 minutes under vigorous stirring. The pulp is then filtered off while warm, and dispersed in 3×500 mL of DI water, filtered, washed thoroughly with 2% aqueous sulphuric acid (500 mL), acetone (3×150 mL) then with DI water (3×500 mL), pressed and stored. $P_g$=248%.

Water contact angle is a suitable measure of hydrophobicity of a material or a product such as those in accordance with the invention. Data on water contact angle measurements for hydrophobic material of the invention show a range over minutes (100 sec). Others in the prior art make claims over milliseconds, at most several seconds. Another possible measure is the thermogravimetric response, where the weight loss below 100° C. indicates if there is a volatile material that is evaporated at the inception of heat application. (The dip for the response of the lignocellulosic fibre indicates moisture evaporates upon heating. It is a straight line for all others.

The invention claimed is:

1. A composite material comprising a hydrophobic cellulosic or lignocellulosic fibre material comprising a hydrophilic cellulosic or lignocellulosic fibre material having a fibre backbone, and a hydrophobic polymer material grafted on said backbone through a covalent bond said hydrophobic polymer material shielding said hydrophilic cellulosic or lignocellulosic fibre material, and a complementary material bonded to the hydrophobic polymer material, wherein said complementary material is a polyolefin.

2. A composite material according to claim 1, wherein the hydrophobic polymer material is derived from polymerized vinyl monomer.

3. A composite material according to claim 2, wherein the vinyl monomer is selected from methyl methacrylate, butyl methacrylate, glycidyl methacrylate, acrylamide, methyl acrylate, butyl acrylate, 4-vinylpyridine, acrylic acid, dimethylaminoethyl methacylate, acrylonitrile and butyl methacrylate.

4. A composite material according to claim 2, wherein the hydrophilic cellulosic or lignocellulosic fibre material is selected from chemical pulp, chemi-thermo-mechanical pulp and thermo-mechanical pulp.

5. A composite material according to claim 4, wherein said pulp is bleached.

6. A composite material according to claim 5, wherein said polyolefin is polyethylene.

7. A composite material according to claim 5, wherein said polyolefin is polypropylene.

8. A composite material according to claim 4, wherein said pulp is unbleached.

9. A composite material according to claim 2, wherein the hydrophobic polymer material forms a graft bridge between fibres.

10. A composite material according to claim 9, wherein said polyolefin is polyethylene.

11. A composite material according to claim 9, wherein said polyolefin is polypropylene.

12. A composite material according to claim 2, wherein the polymerized vinyl monomer contains 3 to 1000 vinyl monomer units.

13. A composite material according to claim 1, wherein said polyolefin is polyethylene.

14. A composite material according to claim 1, wherein said polyolefin is polypropylene.

* * * * *